US005221925A

United States Patent [19]

Cross

[11] Patent Number: 5,221,925

[45] Date of Patent: Jun. 22, 1993

[54] POSITION IDENTIFICATION SYSTEM

[76] Inventor: Anthony D. Cross, Weimarer Str. 3, 6084 Gernsheim, Fed. Rep. of Germany

[21] Appl. No.: 735,834

[22] Filed: Jul. 25, 1991

[51] Int. Cl.[5] ..... G08G 1/123

[52] U.S. Cl. ..... 340/988; 340/989; 340/991; 340/993; 342/457

[58] Field of Search ..... 340/988, 989, 990, 991, 340/992, 993, 994, 995, 933, 426, 539, 901, 904, 905, 286.14; 364/436, 424.01, 449, 460; 342/457; 455/73, 89, 99

[56] References Cited

U.S. PATENT DOCUMENTS

| | | | |
|---|---|---|---|
| 3,377,616 | 4/1968 | Auer, Jr. | 340/989 |
| 3,568,161 | 3/1971 | Knickel | 340/993 |
| 3,646,580 | 2/1972 | Fuller et al. | 340/989 |
| 3,662,267 | 5/1972 | Reed | 340/993 |
| 3,824,469 | 7/1974 | Ristenblatt | 340/905 |
| 3,899,671 | 8/1975 | Stover | 340/905 |
| 4,107,689 | 8/1978 | Jellinek | 340/991 |
| 4,596,988 | 6/1986 | Wanka | 342/457 |
| 4,673,921 | 6/1987 | Saito et al. | 340/991 |
| 4,797,948 | 1/1989 | Milliorn et al. | 455/99 |
| 4,962,457 | 10/1990 | Chen et al. | 340/905 |

*Primary Examiner*—Jin F. Ng
*Assistant Examiner*—Brent A. Swarthout
*Attorney, Agent, or Firm*—Leonard Bloom

[57] ABSTRACT

A position identification and navigation system comprising an active transceiver unit for transmitting a request signal, and a network of passive units for transmitting digital location information back to the active unit in response to the request signal. The active unit receives the information signals and displays the location information to assist in position identification, navigation and tracking.

5 Claims, 4 Drawing Sheets

POSITION IDENTIFICATION SYSTEM

FIELD OF THE INVENTION

The present invention relates to identifying one's position relative to fixed surroundings and, more particularly, to a position identification system including one or more passive transceivers affixed to stationary objects and an active transceiver capable of collecting and displaying positioning information from the passive transceivers.

BACKGROUND OF THE INVENTION

The task of navigating a vehicle in an unfamiliar area is difficult, time-consuming, and an inevitably frustrating experience. The frustration is most acute when one is alone in a vehicle.

Observation of such data is difficult enough. Navigational data such as street signs and building numbers reside outside of the vehicle in non-standard locations. Building numbers are often obscured by trees, shrubs, and fences, and street signs are often missing or misdirected.

Even if the navigational data can be obtained, the process of using it is even more arduous. The data must be correlated on a map or written directions situated inside the vehicle. It is a difficult and dangerous endeavor to divide one's attention between operating a vehicle and reading a map. The above-described difficulties result in a needless risk of safety, and a waste of time and effort.

Navigation inevitably begins with determining one's current position and direction of travel. This requires that a minimum of two street signs be read and correlated on the map. Once the direction is proper and the target street is located, the proper direction on the target street must be ascertained. Again, a minimum of two building numbers must be read. Once the vehicle is headed in the right direction, the operator must continuously view building numbers until the proper building is found.

The above-described repetitive process of determining one's position and direction in relation to fixed surroundings is an unnecessary diversion of time and energy from the primary task of defensive driving. This is at best an inconvenience and a source of additional expense for the commercial driver. At worst, it is a safety hazard and a cause of delay for ambulances and other emergency vehicles. The time expended may spell the difference between the life and death of a patient.

The field of the art is crowded with devices for identifying the position of a remote vehicle or object. For example, in U.S. Pat. No. 4,598,272 issued to Cox, an electronic monitoring apparatus is disclosed which enables a monitoring person to monitor the whereabouts of a monitored person. The Cox system includes a monitoring transceiver and a monitored transceiver. The monitoring transceiver prompts the monitoring transceiver to transmit a reference signal. The monitoring transceiver correlates the strength of the received reference signal with the distance between the two transceivers. The operator of the monitoring transceiver can locate the monitored transceiver by eliminating the distance between the two. The Cox system has many applications in the consumer and commercial market. For example, it can be used to prevent thefts, track deliveries, avoid loss of possessions or children, and any number of other related applications. However, the device has limited capabilities in the field of navigation. It cannot give an immediate indication of geographic position.

Numerous other prior art systems exist for the purpose of determining geographic position. These systems are typically based on a LORAN-C positioning signal. However, such systems are subject to the inherent inaccuracies of ground-based LORAN-C systems, and can provide no more than a cartographic estimate of geographic location. They do not provide specific navigational assistance to the operator of a vehicle who is attempting to locate a specific place or object.

In contrast, U.S. Pat. No. 4,857,840 issued to Lanchais discloses an information and guidance system which is capable of pinpointing its own position. However, Lanchais uses a transceiver which determines its geographic position by using an exceedingly complex methodology. Specifically, the transceiver combines a measurement of the earth's magnetic field with measurements of the distance between itself and a remote station. The combined measurements are used to determine the position. The complexity of the Lanchais system undermines its utility.

In short, none of the prior art systems fulfill the need for a simple position determining and navigational system which will efficiently direct a person to a specific place or thing.

SUMMARY OF THE INVENTION

It is therefore an object of the present invention to provide an on-board position-determining and navigational system capable of supplying a constant flow of visual information relating to one's current position. The present invention is especially suited for identifying the position of a vehicle relative to its surroundings. However, the invention is intended to have much broader application. For example, the invention may be employed by pedestrians, or it may be used to locate lost property or children. There are many conceivable applications. Hence, the invention should not be construed as being limited to a particular purpose. On the contrary, it is a broad object of the present invention to satisfy the different needs of a pedestrian or vehicle operator in determining their own position, or in tracking the location of another person, place or thing.

It is another object of the invention to provide a simple and inexpensive position identification network using a mobile active transceiver and a plurality of stationary passive transceivers.

It is still another object of the invention to provide a position identification system as described above which requires a minimum of operator interface.

It is yet another object of the present invention to provide an effective communication protocol between a plurality of passive transceivers and an active transceiver, the protocol allowing a continuous flow of information between the passive and active transceivers as relative movement occurs therebetween.

It is yet another object of the present invention to provide a position identification system as described with a variety of operating modes to satisfy the needs of an operator.

It is specific object of the invention to simplify the critical tasks of navigating an emergency vehicle to the site of an emergency, or determining the position of a lost or stolen vehicle, animal or child.

According to the present invention, these and other objects are accomplished by providing a position identification and navigation system. The system includes an active transceiver unit for transmitting a request signal, and a network of passive units for transmitting response signals upon receipt of the request signal. The response signals are each encoded with information unique to the originating passive unit. The active unit receives the response signals, decodes the information, and displays the information.

Alternatively, the present invention may comprise a single active transceiver unit as described above, and one or more passive units for transmitting response signals upon receipt of the request signal. The passive unit(s) may be attached to children, animals or vehicles to allow the operator of the active unit to find them when lost or stolen.

BRIEF DESCRIPTION OF THE DRAWINGS

Other objects, features and advantages of the present invention will become more apparent from the following detailed description of preferred embodiments and certain modifications thereof when taken together with the accompanying drawings, in which.

DETAILED DESCRIPTION OF THE PREFERRED EMBODIMENTS

Figure 1:
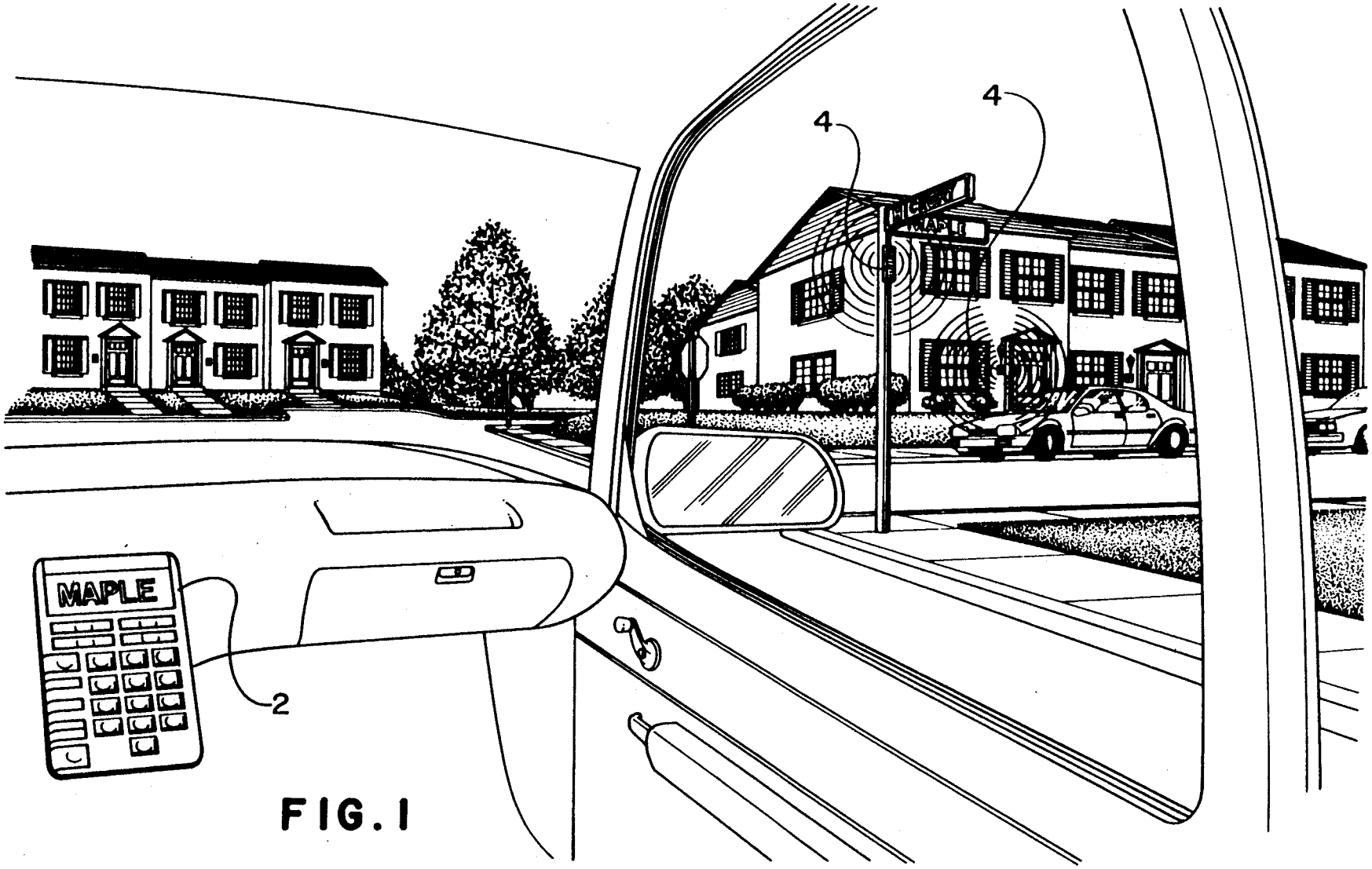
FIG. 1 is a perspective drawing of the navigation network according to the present invention.

FIG. 1 is a perspective drawing of a navigation network according to the present invention, shown in the context of automobile navigation. Alternatively, the invention can be used for navigation of any type of vehicle, as well as pedestrian navigation.

According to the preferred embodiment, the network comprises a plurality of low-cost passive units 4. Passive units 4 may be attached to stationary objects such as buildings or street posts, or alternatively, may be buried at specific locations.

The navigation network also comprises a mobile active unit 2 which can be mounted inside a vehicle. Alternatively, the active unit 2 may be hand-carried for pedestrian navigation or location of others such as children or animals. Active unit 2 may receive its power from the 12 V vehicle supply, a battery, solar cells, or a combination thereof. Preferably, active unit 2 is powered by rechargeable batteries, which are recharged by the 12 V vehicle supply or solar cells. Both active unit 2 and all passive units 4 are capable of transmitting and receiving signals within an adjustable range. The active unit 2 and passive units 4 within range communicate between themselves according to a request-response protocol to be described.

Figure 2:
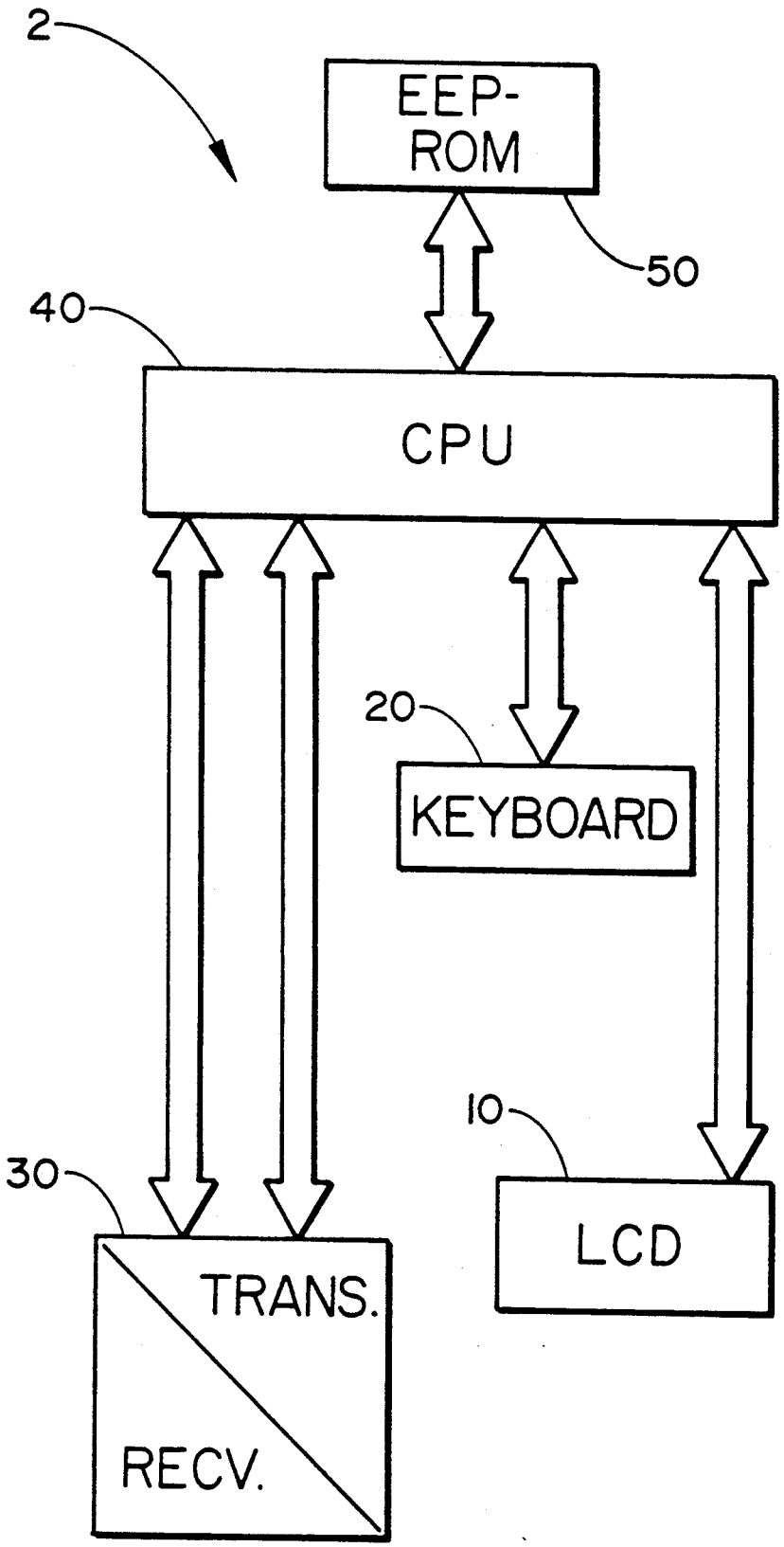
FIG. 2 is a block diagram of an active unit according to one embodiment of the present invention.

FIG. 2 is a block diagram of the preferred embodiment of an active unit 2 according to the present invention. Active unit 2 comprises a display 10 which may be a liquid crystal display (LCD), keyboard 20 which may be a conventional alpha-numeric entry keypad, transceiver 30, memory 50 which is preferably an electronically erasable programmable read-only memory (EEPROM), and a central processing unit 40 communicating over bi-directional busses to all of the above-described peripheral components. Processing unit 40 may be any conventional microprocessor capable of coordinating the operation of the peripherals.

Transceiver 30 may be any conventional FCC-approved transmitter/receiver circuit capable of modulating and demodulating a carrier signal with digital code. Transceiver 30 preferably has an adjustable transmission range. The operation of transceiver 30 is controlled by the central processing unit 40, and digital data to be encoded on the carrier wave is supplied from EEPROM 50 by central processing unit 40.

Keyboard 20 is provided to allow the operator to interface directly with central processing unit 40 for system control and programming of the EEPROM 50. Display 10 is likewise coupled to central processing unit 40 to provide a visual readout during navigation of the vehicle.

In the preferred embodiment, active unit 2 operates in one of three modes, including main mode, selective mode, and selective plus mode. The particular operating mode is chosen by depressing a dedicated key on keyboard 20.

In main mode, central processing unit 40 accesses a digital code stored in EEPROM 50, which code serves as a general request to all passive units 4 within range to transmit a response. The digital code accessed from EEPROM 50 is communicated to transceiver 30 where it is encoded on a carrier signal. The modulated carrier signal is then transmitted. Initially, the main mode transmission of the digitally-encoded request signal is continuous. However, central processing unit 40 times the interval preceding a response. If no response from a passive unit 4 is received within five seconds, central processing unit 40 causes active unit 2 to begin intermittent transmission of the request signal at predetermined intervals of, for instance, every five seconds or so. Such non-continuous transmission conserves power. All passive units 4 within range of active unit 2 transmit a response signal containing digitally-encoded data indicative of the identity or location of the respective passive unit 4. The response signals of all passive units 4 within range are received by active unit 2. The active unit 2 will again switch to continuous request transmission upon receipt of a response from any one of passive units 4. Active unit 2 decodes the data from each received response signal, and the data is displayed at active unit 2 to assist in determining position and in navigation.

Keyboard 20 is also provided with a dedicated reset button which resets the operation of central processing unit 40 and re-initiates continuous transmission.

The operator may manually enter a selective mode at any time by operation of keyboard 20. In selective mode, the operator must program the active unit 2 with selection criteria including the name, number or position of a specific passive unit 4. The active unit 2 will then display only the data received from the selected passive unit 4.

Likewise, the operator may manually enter a selective-plus mode at any time by operation of keyboard 20. In selective-plus mode, central processing unit 40 interjects an additional digital code in the request signal which, when transmitted, serves as a prompt to the selected passive unit 4 to output supplemental information listing surrounding landmarks, describing the particular object or location to which the selected passive unit 4 is attached, etc. Any number or variety of other instructions may be output in this fashion. The supplemental information may provide additional assistance or instructions to emergency vehicle operators or commercial delivery services, etc.

Figure 3:
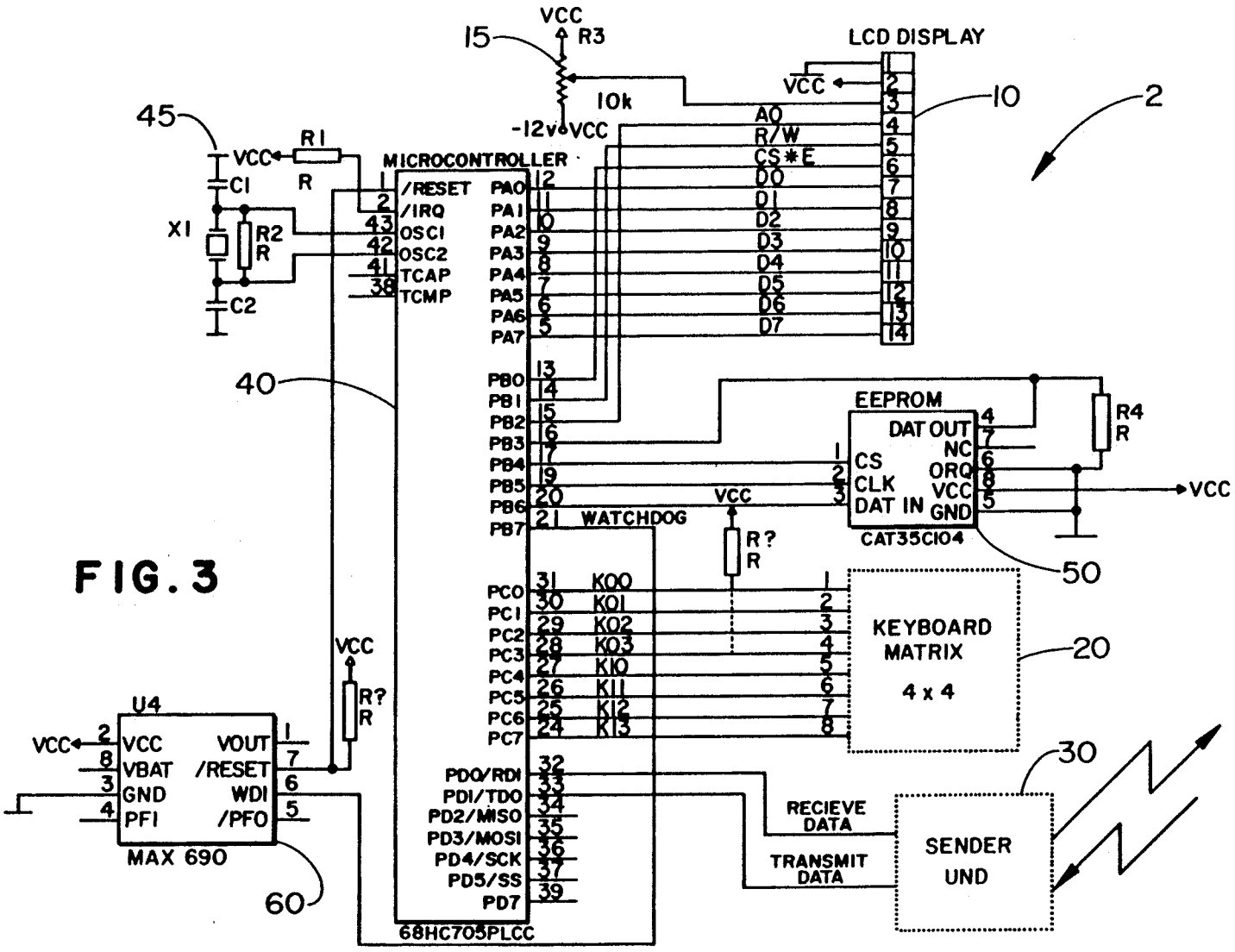
FIG. 3 is a detailed circuit diagram of the active unit of FIG. 2.

FIG. 3 is a detailed circuit diagram of the active unit 2 of FIG. 2. Central processing unit 40 controls the entire operation of active unit 2. Central processing unit 40 may be any conventional microprocessor, although the illustrated embodiment incorporates a Motorola 68HC705PLCC. As shown, central processing unit 40 is provided with a complementary clock 45.

Display 10 may be a conventional liquid crystal display (LCD) having an 8-character alpha-numeric readout driven by lines PA0–PA7 from central processing unit 40. Central processing unit 40 controls display 10 via strobe line (CS*E), read/write (R/W) line, and enable line (A0). In addition, display 10 may be provided with a brightness control 15.

EEPROM 50 is likewise coupled directly to central processing unit 40 via lines PB3–PB6. EEPROM 50 may be any conventional EEPROM, although a CAT35C104 is incorporated in the present embodiment. EEPROM 50 may be pre-programmed before assembly, or it may be programmed after assembly by operation of keyboard 20. EEPROM 50 is programmed with the digital code(s) to be encoded in the request signal which prompt a response from the passive units 4. EEPROM 50 allows storage of fixed data independently of the power source.

Keyboard 20 may be any conventional keyboard, although a 4×4 4 keyboard matrix is preferred. In the illustrated embodiment, eight data inputs from keyboard matrix 20 are provided directly to central processing unit 40 over lines KO0–KI3.

Transceiver 30 also communicates directly with central processing unit 40 via a receive data line PD0/RDI and a transmit data line PD1/TD0. As explained, transceiver 40 may be any conventional transceiver capable of sending and receiving data which has been encoded in digital form on a carrier wave. Transceiver 30 decodes the digital data from the carrier wave. Preferably, the power level of transceiver 30 is adjustable to vary the maximum transmission range. A narrower range increases the operational effectiveness in congested areas such as cities, trailer parks, etc. The carrier frequency of transceiver 30 is unimportant, so long as it can be effectively modulated with digital code accessed from EEPROM 50 by central processing unit 40. The transceiver should have an adjustable maximum range.

Watchdog timer 60 performs a simple watchdog timing function to monitor the time intervals between reception of a response from a passive unit 4. Preferably, if more than 5 seconds pass before transceiver 30 receives a response, watchdog timer 60 causes central processing unit 40 to begin intermittent transmissions. This avoids needless transmissions, and the delay between transmissions conserves power.

Figure 4:
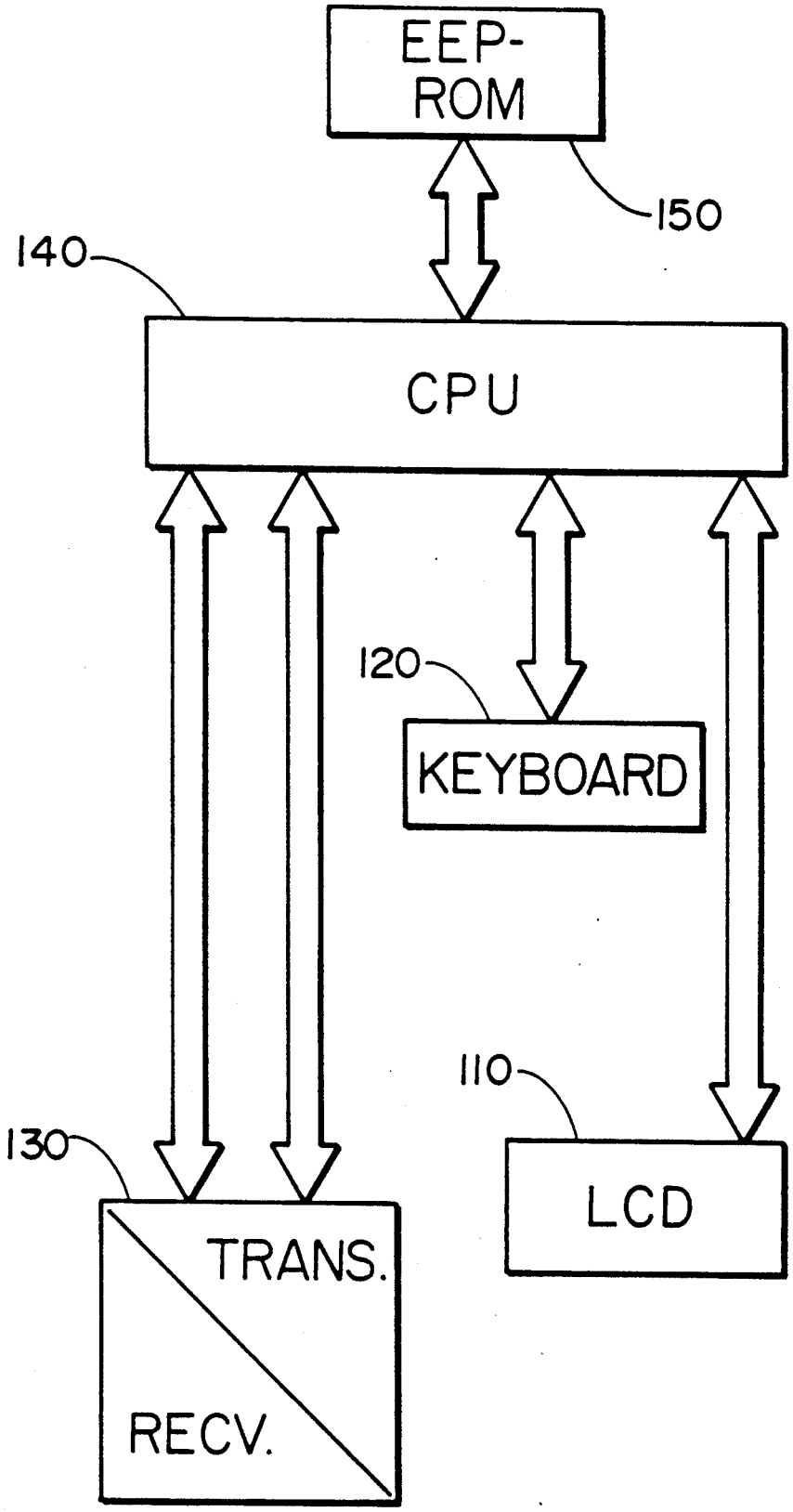
FIG. 4 is a block diagram of a passive unit according to one embodiment of the present invention.

FIG. 4 is a block diagram of the preferred embodiment of a passive unit 4 according to the present invention. Passive unit 4 is substantially similar to the active unit 2 of FIG. 2. Passive unit 4 comprises a display 110, a keyboard 120, a transceiver 130, a memory 150, and a central processing unit 140 communicating over bi-directional busses to all of the above-described peripheral components. Preferably, the above-described components of the passive unit 4 are identical to their counterparts on the active unit 2.

Keyboard 120 is provided to allow the operator to interface directly with central processing unit 140 for system control and programming of the EEPROM 50.

Display 110 is likewise coupled to central processing unit 40 to provide a visual readout at the passive unit 4.

EEPROM 150 is coupled directly to central processing unit 140 via a bi-directional bus. EEPROM 150 may be pre-programmed before assembly, or it may be programmed after assembly by operation of keyboard 120. EEPROM 150 is programmed with the digital code(s) corresponding to the request signal transmitted from active unit 2. EEPROM 150 is also programmed with location information which is unique to each passive unit 4, and with any desired supplemental information and instructions which may assist in navigation. EEPROM 150 also allows storage of fixed data independently of the power source.

Transceiver 130 also communicates directly with central processing unit 140 via a receive data line PD0/RDI and a transmit data line PD1/TD0. Transceiver 130 may be any conventional transceiver capable of sending and receiving data which has been encoded in digital form on a carrier wave. Transceiver 130 decodes the digital data from the carrier wave. The transmission range of transceiver 130 is preferably 200 meters. By adjusting the transmission range of active unit 2, the number of passive units 4 which receive the request signal can be controlled. This allows the operator to be more selective in congested areas. The carrier frequency of the passive unit transceiver 130 is unimportant, so long as it can be effectively modulated with digital code accessed from EEPROM 150.

Central processing unit 140 controls the operation of all of the above-described peripheral components. Central processing unit 140 is provided with a complementary clock 145.

The operation of the position determining and navigational system will now be described with reference to FIGS. 2–4.

Initially, the EEPROM 150 in each passive unit 4 is programmed with a unique binary identification code. In addition, EEPROM 150 may be programmed with additional supplemental information or instructions as desired. For instance, programming may include navigational instructions, warnings about one-way streets, road conditions, or even emergency life-saving procedures. Similarly, EEPROM 150 may be programmed to provide a description of the particular person, place or thing on which it is attached.

As previously explained, EEPROM 50 in active unit 2 is programmed to correlate the unique identification code received from each passive unit 4 with the identity or location of the particular passive unit.

When turned on, central processing unit 40 initializes active unit 2 in main mode, and a request signal is continuously transmitted from transceiver 30. The main mode request signal serves as an invitation to all of passive units 4 to respond.

While the passive units 4 are out of range, the transmitter portion of each passive unit transceiver 130 is held in standby state. The transmitter portion of each transceiver 130 remains in the standby state until a request signal is received from active unit 2. All passive units 4 within range of active unit 2 are removed from standby and immediately respond to the request. Conversely, if no passive units 4 are within range, then no response will be received. Watchdog timer 60 monitors the time preceding a response, and if no response is received within 5 minutes a time-out will occur. When Watchdog 60 senses a timeout, it will prompt central processing unit 40 to enter a delayed transmission mode in which the request signal is transmitted once every 5 seconds. The delayed transmission mode helps to conserve power.

If a passive unit 4 comes within range of active unit 2, then passive unit 4 will receive the request signal at transceiver 130. At this point, central processing unit 140 releases the transmitter portion of transceiver 13 from its standby state. The received request signal prompts central processing unit 140 to download its unique location information stored in EEPROM 150 to transceiver 130 for return transmission to active unit 2. Transceiver 130 modulates the digital code onto a carrier signal and transmits the modulated response to active unit 2.

Each passive unit 4 transmits a response each time it receives a request from active unit 2. The request-response protocol continues until active unit 2 is out of range.

After each passive unit 4 transmits its response signal, the standby state of the transceiver 130 is reestablished until another request signal is received. To avoid interference with transmissions by other passive units 4, each passive unit 4 may be programmed to interject a random delay between the time a request signal is received and a response signal is transmitted.

As the passive unit 4 response signal is received at active unit 2, the unique location information is demodulated from the carrier signal by transceiver 30, and the location information is communicated to central processing unit 40. Central processing unit 40 then outputs the location information on display 10. This provides a visual indication of the whereabouts of the vehicle.

At any time during normal main mode operation of the system, active unit 2 may be programmed by the operator via keypad 20 to enter the selective mode or selective plus mode. If the operator indicates that he wishes to enter the selective mode, central processing unit 40 prompts the operator via display 10 to enter a specific number, name or location of a particular passive unit 4. Active unit 2 then transmits a general request signal which solicits a response from all passive units 4 within range. The passive units 4 within range each transmit an encoded response identifying its number, name or location. The active unit 2 receives all the responses, however, active unit 2 will disregard responses from passive units 4 which do not meet the selection criteria entered by the operator. Upon receiving a response from the passive unit 4 which does meet the selection criteria, active unit 2 will preferably signal the fact that the selected passive unit has been located either optically (e.g. by a blinking light), acoustically (e.g. by a signal tone), or both. In addition, the communication is indicated on visual display 20.

Similarly, the operator may choose to initiate selective plus mode. In selective plus mode, the operator programs the active unit via keyboard 20 with a selected name, number or position of a specific passive unit 4. Transceiver 30 then encodes the carrier signal with the identifier code corresponding to the name, number or location which is stored in EEPROM 50. In addition, central processing unit 40 interjects an additional digital code which serves as a prompt to the selected passive unit 4 to output the supplemental information stored in its EEPROM 150. The supplemental information stored in EEPROM 150 may be numerical or textual material listing surrounding landmarks or describing the particular object or location to which the selected passive unit 4 is attached. Any number or variety of other instructions may also be stored in EEPROM 150. This information may be helpful to emergency vehicle operators or commercial delivery services, etc.

As an additional feature of the invention, the reliability and utility of the navigation network can be increased in the selective mode by further programming active unit 2 to screen the response from the selected passive unit 4 and, in addition, the responses from the two particular passive units 4 which are closest to the selected passive unit 4. Upon receiving a request signal encoded with the identifier of the selected passive unit 4 and the two adjacent passive units 4, the location information for all three selected passive units 4 is displayed at active unit 2. The additional location information from the adjacent passive units 4 may serve as a cross-check to insure that transmissions errors did not occur. Likewise, it can be determined whether the selected passive unit 4 is inoperative.

In alternative embodiments of the present invention, a single active unit 2 as described above may be used with a single passive unit 4 as described above to locate lost or stolen children, pets or vehicles. In such an embodiment, passive unit 4 is attached to the child, animal or vehicle of interest to allow the operator of the active unit 2 to find them. Crowded areas such as stadiums, and entrances and exits of buildings such as shopping malls may be equipped with a plurality of active units 2. The position of the passive unit 4 can then be determined whenever the passive unit 4 comes within range of a particular active unit 2. Reducing the range of active unit 2 allows a more precise determination of location.

Similarly, a single active unit 2 as described above may be used to track a plurality of mobile passive units 4 as described above. This arrangement can be helpful in controlling public transportation such as busses and taxis. In addition, the passive units 4 can be programmed with the identification number of the vehicle in which they are mounted to allow tracking of stolen vehicles.

Having now fully set forth the preferred embodiments and certain modifications of the concept underlying the present invention, various other embodiments as well as certain variations and modifications of the embodiment herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. A position identification system, comprising:

a passive unit, said passive unit consisting essentially of a memory in which a location of said passive unit is stored as digitally-encoded data, a transceiver for receiving a request signal, and thereupon transmitting a response signal comprising said digitally-encoded data modulated on a carrier wave, a processor connected to said memory and transceiver for controlling transmission of said response signal in accordance with receipt of said request signal, and a display connected to said processor for providing a visual indication of the information in said memory; and an active unit, said active unit consisting essentially of, a transceiver for transmitting said request signal to said passive unit, and for receiving said response signal and de-modulating said digitally-encoded data from said carrier wave, a processor connected to said transceiver for downloading said digitally encoded data therefrom, a keyboard connected to said processor for allowing operator entry of selection criteria;

a memory connected to said processor for storing said selection criteria, whereby said processor compares said digitally-encoded data with said selection criteria, a display connected to said processor for displaying said digitally encoded data to an operator;

whereby said active unit transmits said request signal to said passive unit and said passive unit transmits said digitally-encoded data in response, and said active unit receives said digitally-encoded data, compares said digitally-encoded data to said selection criteria, and displays said location of said passive unit to said operator in real-time for navigational assistance in accordance with said selection criteria.

2. A position identification system according to claim 1, wherein said passive unit further comprises a battery for providing power thereto.

3. A position identification system according to claim 2, wherein said passive unit further comprises a solar cell for providing power and for providing a charging current to said battery.

4. A position identification system, comprising:

a plurality of passive units arranged in a geographical network, said passive units each further comprising, a memory in which a location of said passive unit is stored as digitally-encoded data, a transceiver for receiving a request signal, and thereupon transmitting a response signal comprising said digitally-encoded data modulated on a carrier wave, a processor connected to said memory and transceiver for controlling transmission of said response signal in accordance with receipt of said request signal; and an active unit, said active unit further comprising, a transceiver for transmitting said request signal to said passive units, and for receiving said response signal from each passive unit within range and de-modulating said digitally-encoded data therefrom, a keyboard for allowing operator entry of selection criteria;

a memory for storing said digitally-encoded data and said selection criteria, a processor connected to said transceiver, keyboard and memory for downloading said digitally encoded data and selection criteria from the respective transceiver and keyboard, and for controlling storage of said digitally-encoded data and said selection criteria in said memory, a display connected to said processor for displaying said digitally encoded data to an operator in real time;

whereby said active unit transmits said request signal to said passive units and all passive units within range transmit said digitally-encoded data in response, and said active unit receives said digitally-encoded data, said processor being selectively operable in any one of two separate modes for comparing said digitally-encoded data with said selection criteria, said modes including a main mode wherein said active unit receives said digitally-encoded data from each of said passive units within range and displays said digitally encoded data to said operator in real time, and a selective mode wherein said active unit receives said digitally-encoded data from each of said passive units within range, compares said digitally-encoded data to said selection criteria, and displays said digitally-encoded data from one of said passive units selected in accordance with said selection criteria.

5. A position identification system, comprising:

a mobile passive unit attached to a person, place or thing to allow tracking thereof, said passive unit consisting essentially of a memory in which a location of said passive unit is stored as digitally-encoded data, a transceiver for receiving a request signal, and thereupon transmitting a response signal comprising said digitally-encoded data modulated on a carrier wave, a processor connected to said memory and transceiver for controlling transmission of said response signal in accordance with receipt of said request signal; and an active unit for tracking said passive unit, said active unit consisting essentially of, a transceiver for transmitting said request signal to said passive unit, and for receiving said response signal and de-modulating said digitally-encoded data from said carrier wave, a processor connected to said transceiver for downloading said digitally encoded data therefrom, a keyboard connected to said processor for allowing operator entry of selection criteria;

a memory connected to said processor for storing said selection criteria, whereby said processor compares said digitally-encoded data with said selection criteria, a display connected to said processor for displaying said digitally encoded data to an operator;

whereby said active unit transmits said request signal to said passive unit and said passive unit transmits said digitally-encoded data in response, and said active unit receives said digitally-encoded data, compares said digitally-encoded data to said selection criteria, and display said location of said passive unit to said operator in real-time for navigational assistance in accordance with said selection criteria.

* * * * *